United States Patent [19]

Coldren

[11] Patent Number: 4,685,754

[45] Date of Patent: Aug. 11, 1987

[54] ELECTRICAL TAB RECEPTACLE

[75] Inventor: Daniel R. Coldren, Enola, Pa.

[73] Assignee: AMP Incorporated, Harrisburg, Pa.

[21] Appl. No.: 808,760

[22] Filed: Dec. 13, 1985

[51] Int. Cl.[4] ..... H01R 11/22; H01R 13/62

[52] U.S. Cl. ..... 439/270; 439/849

[58] Field of Search ..... 339/74 R, 256 R, 256 SP, 339/258 R, 258 S

[56] References Cited

U.S. PATENT DOCUMENTS

| | | | |
|---|---|---|---|
| 2,770,792 | 11/1956 | Batcheller | 339/258 S |
| 3,976,348 | 8/1976 | Simmons | 339/258 S |
| 4,167,299 | 9/1979 | Noguchi | 339/74 R |
| 4,534,613 | 8/1985 | Esser | 339/258 S |
| 4,558,913 | 12/1985 | Goto et al. | 339/258 S |

FOREIGN PATENT DOCUMENTS

| | | | |
|---|---|---|---|
| 0043655 | 1/1982 | European Pat. Off. | 339/74 R |

*Primary Examiner*—E. Michael Combs

*Attorney, Agent, or Firm*—Robert W. J. Usher

[57] ABSTRACT

An electrical receptacle (11) for tabs of small size is formed from sheet metal and comprises a generally channel-shaped receptacle portion (12) having a base (13) and upstanding side walls (14, 14'). Free edge portions (15, 15') of the side walls are bent towards each other over the base and a locking tongue (16) is struck out from the base to extend rearwardly within the receptacle portion from a front root end (18) integral with the base to a rear free end. The free end is formed with a release member (19) projecting out of the receptacle portion and a locking projection (21) on the tongue between the ends which provides a rearwardly facing shoulder for latching engagement in a recess in a tab (22) inserted into the receptacle. The tongue (16) is of arcuate transverse cross section and is stiff constituting, with a portion of the base forward of the root end a torsion bar of generally T-shape. Movement of the tongue towards the base to release the tab causes resilient torsional flexure of the base portion.

1 Claim, 6 Drawing Figures

11
12
13
13'
15
16
18
19
21
23

ELECTRICAL TAB RECEPTACLE

The invention relates to an electrical tab receptacle of the type which is adapted to be releasably latched onto a mating tab.

Such receptacles are stamped and formed from sheet metal and may comprise a generally channel-shaped receptacle portion having a base and upstanding side walls with free edge portions of the side walls bent towards each other over the base and a locking tongue struck out from the base to extend rearwardly within the receptacle portion from a front root end integral with the base to a rear free end formed with a release member projecting out of the receptacle portion, a locking projection on the tongue between the ends providing a rearwardly facing shoulder for latching engagement in a recess in a tab inserted into the receptacle, unlatching movement of the tongue to release the tab being obtained by depression of the release member.

Examples of this kind of receptacle are described in U.K. Pat. No. 1531033, Japanese design application No. 80/021232, and European patent application No. 81302634.

Receptacles of this type have become very widely accepted, particularly in the automobile industry, where a positive latching characterisitic is required for reliability of operation. However, reliabilitly problems have occasionally been experienced with this kind of terminal which relies predominately on the flexural characteristics of the tongue to obtain latching and unlatching. This is because weakness in the tongue often provides an excessively soft and unreliable spring characteristic. Weakness of the residual marginal portions of the base on each side of the tonge as a result of striking out of the tongue may also result in distortion of the receptacle during use.

The base may be additionally weakened by a requirement to bend up edges of the marginal portions to provide improved contact with an inserted tab.

For this reason, more expensive receptacles of the type exemplified in U.K. Pat. No. 1465371 (4581) have been predominately used since the introduction of the receptacle some ten years ago. In this example, the tongue is not struck out from the base but extends initially from a forward edge of the base and is then bent back to extend rearwardly within the receptacle, providing a more reliable spring characteristic with a stronger base.

The problem of tongue weakness is accentuated when it is desired to make a receptacle suitable for small tabs such as 0.110 inch size, as the tongue is then very thin and narrow resulting in a very soft spring characteristic while very little metal remains in the marginal portions of the base after the tongue is struck therefrom.

It has therefore been proposed to provide guiding features in oversize receptacles to permit their use with small sizes of tabs. Examples of receptacles so adapted are disclosed in EP-A-No. 84306702 and EP-A-No. 0098650. However, the result is an excessively large and expensive connector assembly.

According to the invention, a receptacle of the type described above in the second paragraph of this specification is characterised in that the tongue is formed into transversely arcuate cross section and is stiff whereby latching and unlatching movement of the tongue is obtained substantially entirely by resilient torsional flexure of a portion of the base located forwardly of the root end of the tongue.

The forward portion of the base together with the stiffly resilient tongue constitute a T-shape torsion bar which has a positive and reliable spring characteristic. Thus the tongue acts as a stiff lever arm and reliable latching and unlatching is obtained.

One example of an electrical receptacle according to the invention will now be described with reference to the accompanying drawings in which.

Figure 1:
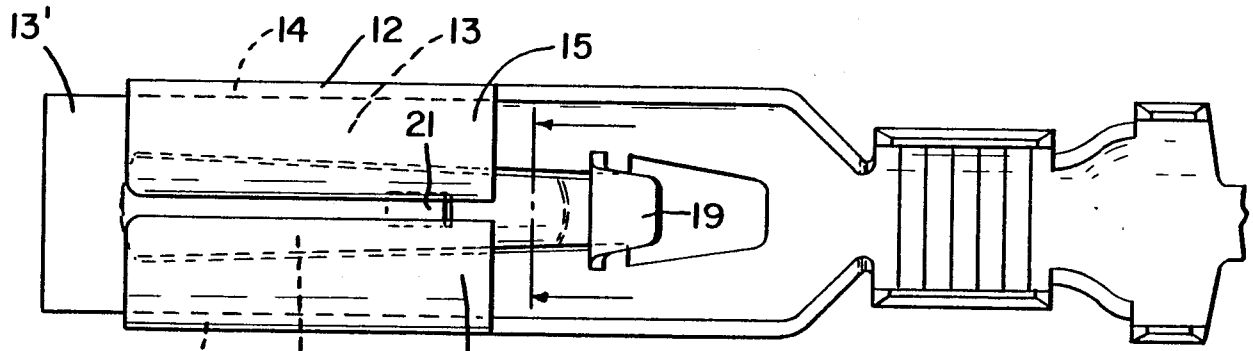
FIG. 1 is a plan view of the receptacle.
Figure 6:
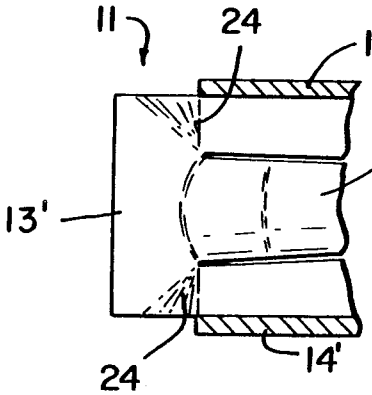
FIG. 6 is a plan view of a front end portion of the receptacle partly in cross section with the tongue depressed to an unlatching condition.
Figure 5:
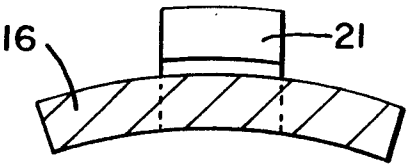
FIG. 5 is a fragmentary cross-sectional view taken along line 5—5 in FIG. 1 showing the latching tongue of the receptacle.

The receptacle 11 is stamped and formed from a single piece of sheet metal and comprises a generally channel-shaped receptacle portion 12 having a base 13 and upstanding side walls 14, 14' with free edge portions 15, 15', respectively, of the side walls bent towards each other so that they are curved over towards the base. The base is formed with a substantially flat axial extension 13' which protrudes forwardly of the side walls and is inclined downwardly towards its fee end at a small indication to facilitate tab guiding. A locking tongue 16 is stuck out from the base and extends rearwardly within the receptacle portion 12 from a front root end 18 integral with the base at a location substantially in transverse alignment with the leading end of the side walls to a rear free end formed with a release arm 19 projecting out of the receptacle portion away from the base. A locking projection 21 providing a rearwardly facing shoulder is formed on the tongue between the ends for latching engagement in a recess 22 in a tab 23 inserted into the receptacle.

The tongue is formed into transversely arcuate cross section such that it constitutes a stiff beam.

A conventional crimping ferrule 26 extends integrally from the rear of the receptacle.

Figures 2, 3, 4:
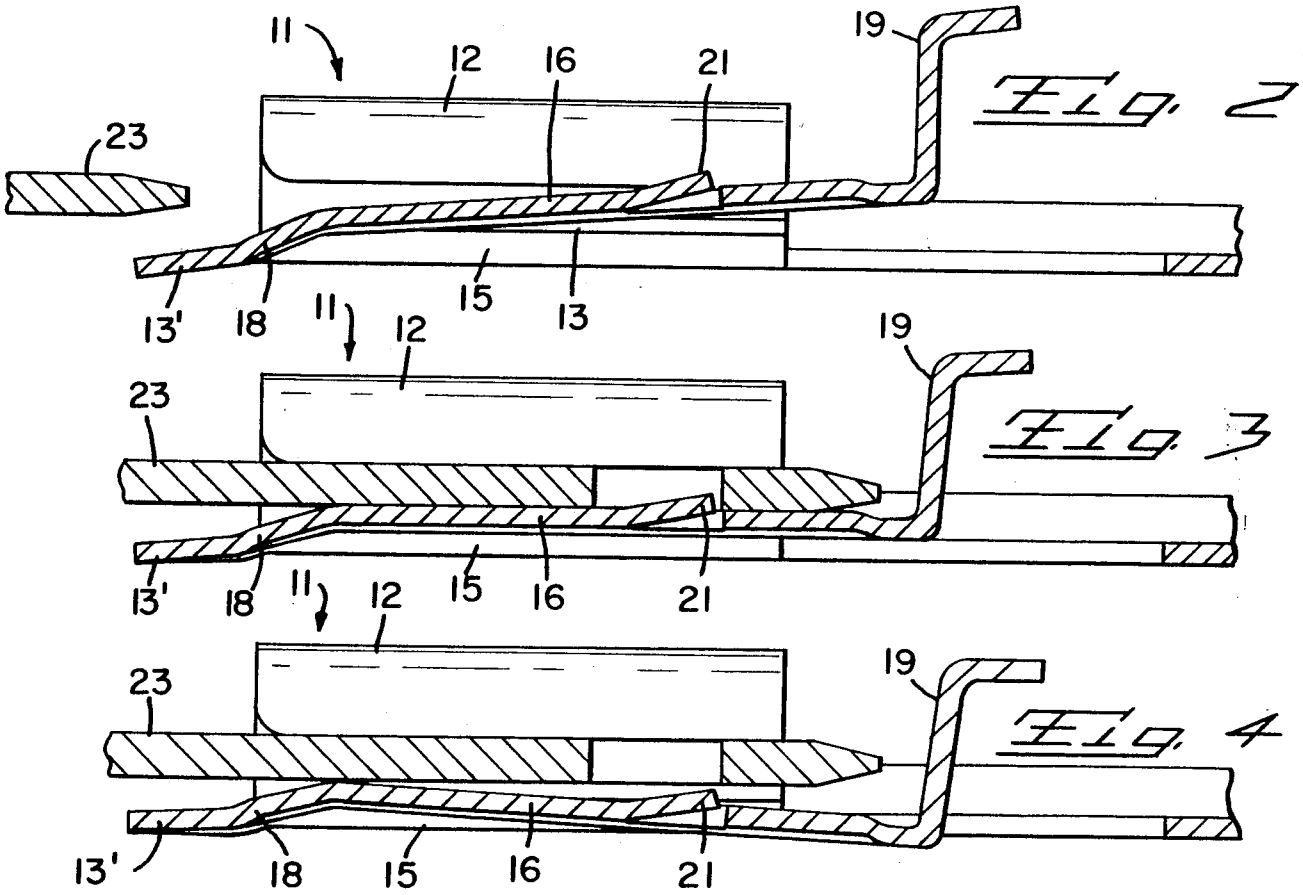
FIGS. 2, 3 and 4 are axial cross-sectional views of the receptacle in unmated condition, mated and latched condition, and mated and unlatched condition, respectively.

As shown particularly in FIGS. 3 and 4, depression of the release arm 19 causes torsional flexure of marginal portions 24, 24' of the base predominately located forwardly of and between the root end of the tongue and the opposite lateral edges of the base to permit the tongue to be displaced towards the base sufficiently to release the locking projection 21 from the aperture in the tab. This results in a small upward pivotal movement of the free end of the extension 13' as shown in FIG. 4. The tongue acts as a lever torsionally flexing the marginal portions 24, 24' with very little or substantially no flexure of the tongue.

This enables reliable latching and unlatching to be obtained with a relatively narrow tongue. The residual marginal portions of the base remaining after striking out the tongue can be relatively wide, while the receptacle can be manufactured in a small sized for mating, for example, with a 110-series tab.

What is claimed is:

1. An electrical receptacle for tabs of small size which receptacle is formed from sheet metal and comprises a generally channel-shaped receptacle portion having a base and upstanding side walls with free edge portions of the side walls bent towards each other over the base, the base being formed with a substantially flat axial extension located forwardly of the sidewalls and inclined downwardly towards a leading free end, a locking tongue struck out from the base to extend rearwardly within the receptacle portion from a front root end integral with the base at a location substantially in transverse alignment with leading ends of the side walls to a rear free end formed with a release member projecting out of the receptacle portion, a locking projection on the tongue between the ends providing a rearwardly facing shoulder for latching engagement in a recess in a tab inserted into the receptacle, unlatching movement of the tongue being obtained by depression of the release member, the tongue being formed into arcuate transverse cross section such that it is stiff, constituting with the extension a torsion bar of generally T-shape, unlatching movement of the tongue towards the base to release the tab causing resilient torsional flexure of the base portion with upward pivotal movement of the leading end of the extension.

* * * * *